US005619972A

United States Patent [19]

Kuenzli et al.

[11] Patent Number: 5,619,972

[45] Date of Patent: Apr. 15, 1997

[54] DEMAND PRESSURE REGULATOR

[75] Inventors: Ronald B. Kuenzli, Deford; Charles H. Tuckey, Cass City, both of Mich.

[73] Assignee: Walbro Corporation, Cass City, Mich.

[21] Appl. No.: 674,892

[22] Filed: Jul. 3, 1996

[51] Int. Cl.[6] ..... F02M 37/04

[52] U.S. Cl. ..... 123/497; 123/511; 123/457; 137/505.42

[58] Field of Search ..... 123/497, 509, 123/510, 511, 457; 137/505.4, 505.42, 854, 907

[56] References Cited

U.S. PATENT DOCUMENTS

| | | | |
|---|---|---|---|
| 5,027,784 | 7/1991 | Osawa et al. | 137/854 |
| 5,226,392 | 7/1993 | Breuer et al. | 137/505.42 |
| 5,458,104 | 10/1995 | Tuckey | 123/467 |
| 5,507,318 | 4/1996 | Israelson | 137/854 |
| 5,524,592 | 6/1996 | Woody et al. | 137/907 |

*Primary Examiner*—Thomas N. Moulis
*Attorney, Agent, or Firm*—Barnes, Kisselle, Raisch, Choate, Whittemore & Hulbert, P.C.

[57] ABSTRACT

A valve in a fuel pressure regulator prevents liquid fuel from being emitted exteriorly of the regulator housing and onto heated engine components. In the preferred embodiment, the valve allows gaseous flow into a chamber of the regulator when the pressure within the chamber is lower than the pressure of gases exterior of the regulator but prevents gaseous flow from within the chamber to the exterior of the housing. In other embodiment an air-bleed passage is provided in the valve to allow gaseous flow from within the chamber to the exterior of the regulator.

14 Claims, 2 Drawing Sheets

DEMAND PRESSURE REGULATOR

FIELD OF THE INVENTION

This invention relates to pressure regulators and more particularly to a pressure demand regulator for fuel for an internal combustion engine.

BACKGROUND OF THE INVENTION

In many engines with fuel injection systems it is desirable to supply liquid fuel to the fuel injector or injectors at a substantially constant pressure. In a no return fuel delivery system, when the engine is not consuming fuel, fuel remains in the fuel lines, fuel pressure regulator, and in the fuel rail connected to the fuel injectors. During normal operating conditions the fuel rail becomes heated and tends to heat the fuel therein causing that fuel to expand.

U.S. Pat. No. 5,458,104 discloses an accumulating fuel pressure regulator with a diaphragm capable of being displaced to accommodate expansion of the fuel. This system has a manifold reference to maintain a constant pressure drop across the fuel injectors. In this system, if the diaphragm ruptures liquid fuel can be emitted from the regulator onto the manifold or other heated engine components creating a potentially hazardous situation. To avoid this hazard, two diaphragms are needed to prevent fuel from being emitted from the regulator onto the heated manifold or other engine components if the first diaphragm ruptures.

In other systems the fuel pressure regulator is referenced at or near atmospheric pressure. Additional features are also needed in these fuel pressure regulators to prevent fuel from being emitted from the pressure regulator and onto heated engine components. Further, in previous systems a spring has been used to bias the diaphragm and when the system becomes heated the spring force decreases due to the rise in temperature permitting the diaphragm to be more easily displaced thereby further increasing the volume of the fuel chamber of the pressure regulator. This reduced spring force decreases the pressure at which the fuel is delivered to the fuel injectors and thereby undesirably affects the performance of the fuel injectors and hence, the engine.

SUMMARY OF THE INVENTION

A valve is provided for a fuel pressure regulator having liquid and gas chambers separated by a diaphragm to prevent liquid flow out of the gas chamber and control the gaseous flow into and out of the gas chamber. The valve allows gaseous flow into the gas chamber when the pressure within the gas chamber is lower than the pressure of gases exterior of the regulator and prevents liquid and gaseous flow from within the gas chamber to the exterior of the regulator. Thus, under normal operating conditions, when the gas chamber becomes heated, the pressure of gas within the gas chamber increases and exerts a force on the diaphragm tending to increase and better control the pressure of liquid fuel in the liquid chamber and at which it is discharged from the regulator. This increased pressure on the diaphragm compensates for the decrease in spring force acting on the diaphragm due to the increase in temperature to thereby maintain a constant fuel delivery pressure to the fuel injectors of the engine.

In another embodiment, the valve is formed with an air-bleed passage therein to permit gaseous flow from within the gas chamber to the exterior of the housing while preventing fluid flow from the gas chamber if the diaphragm ruptures. In this embodiment, the pressure within the gas chamber remains substantially the same as the pressure of gases exterior of the housing.

In each embodiment, if the diaphragm of the regulator ruptures, the valve prevents liquid from flowing through the gas chamber to the exterior of the housing. Thus, the invention eliminates the need for a second, or "back-up" diaphragm.

Objects, features and advantages of this invention are to provide a fuel pressure demand regulator which compensates for the reduced spring force acting on the diaphragm due to an increased temperature within the regulator to maintain a constant outlet fuel pressure, maintains the pressure within the gas chamber at or above the pressure of gases exterior of the regulator, prevents liquid fuel flow through the valve to the exterior of the diaphragm thereby greatly reducing the risk of a potentially hazardous emission of liquid fuel from the regulator and eliminating the need for a second or back-up diaphragm, can be provided with an air-bleed passage to maintain the pressure within the gas chamber substantially equal to the pressure of gases exterior of the regulator, is rugged, durable, maintenance free, of relatively simple design and economical manufacture and assembly and has a long in service useful life.

DESCRIPTION OF THE DRAWINGS

These and other objects, features and advantages of this invention will be apparent from the following detailed description of the preferred embodiments and best mode, appended claims and accompanying drawings in which:

DETAILED DESCRIPTION OF THE PREFERRED EMBODIMENTS

Figure 1:
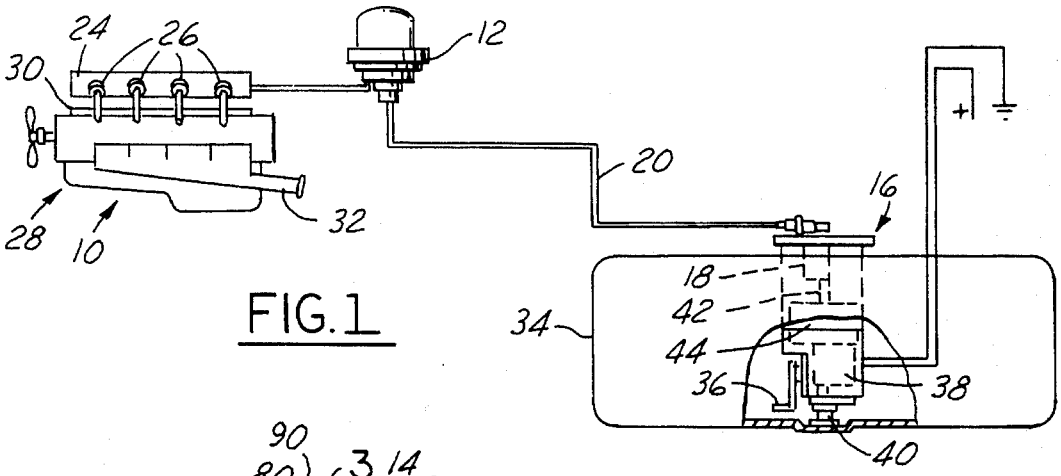
FIG. 1 is a schematic view of a fuel system with a fuel pressure regulator embodying this invention.

FIG. 1 illustrates a no-return fuel delivery system 10 incorporating a demand fuel regulator 12 embodying this invention with a control valve 14. The fuel delivery system 10 has a fuel pump module 16 with a fuel manifold 18 connected through the regulator 12 by fuel lines 20 a fuel rail 24 and fuel injectors 26 of an internal combustion engine 28 with an air-intake manifold 30 and an exhaust manifold 32 for an automotive vehicle, such as an automobile. The fuel pump module 16 is mounted in a fuel tank 34 and has a fuel level sensor 36 and a fuel pump 38 with an inlet 40 communicating with the fuel tank 34 and an outlet 42 communicating with the manifold inlet. The pump 38 is driven by an electric motor 44, the speed of which may be varied to control the pressure of fuel delivered by the pump 38 to the regulator 12 to produce a regulated substantially constant fuel pressure to the inlet of the fuel regulator. Fuel is supplied at a reduced pressure by the demand regulator 12 to the fuel rail 24. The fuel system does not have any fuel return line from the rail 24 or regulator 12 to the fuel tank 34 and is often referred to as a no-return fuel system.

Figure 2:
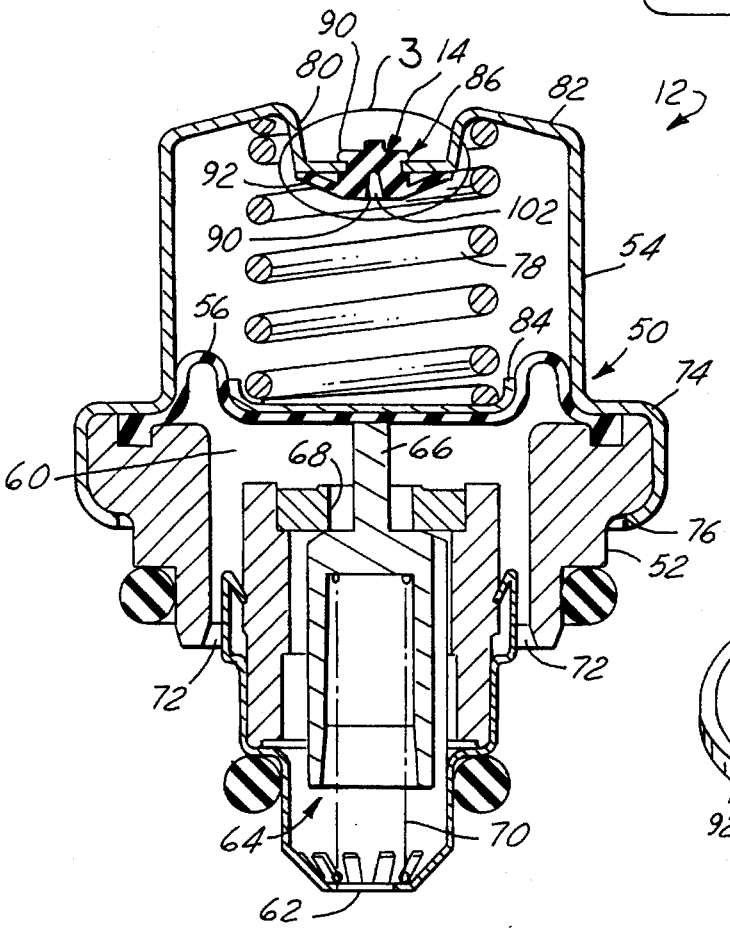
FIG. 2 is a sectional view of the fuel pressure regulator.

As shown in FIG. 2, the regulator 12 has a housing 50 defined by a body 52 and a cap 54. A flexible diaphragm 56 is received between the cap 54 and the body 52 and defines a gas chamber 58 on one side of the diaphragm 56 and a liquid fuel chamber 60 on the other side of the diaphragm 56. The body 52 has an inlet 62 and a first valve 64 associated with the inlet 62 to open and close the inlet 62 and thereby control fuel flow through the inlet 62. An actuator pin 66 is carried by the valve 64 and extends adjacent to the diaphragm 56 such that in normal operating conditions the diaphragm 56 actuates the pin 66 to open the first valve 64 and allow fuel flow through the inlet 62. When the diaphragm 56 is deflected upwardly away from the pin 66, the first valve 64 is biased to a closed position onto a valve seat 68 by a spring 70. Liquid fuel in the fuel chamber 60 is discharged through spaced outlet ports 72 to the fuel rail 24.

The cap 54 is secured to the body 52 by a flange 74 with a return bend portion 76 rolled around the body 52 during assembly of the components. A coil spring 78 is disposed within the gas chamber 58, defined by the cap 54 and the diaphragm 56, to yieldably bias the diaphragm 56 against the actuator pin 66 and thereby open the valve 64. To retain the spring 78 in generally coaxial alignment with the longitudinal axis of the regulator 12 an annular shoulder 80 is provided in the top wall 82 of the cap 54 adjacent one end of the spring 78 and a retainer disk 84 is provided adjacent the diaphragm 56 to retain and locate the other end of the spring 78. To communicate the exterior of the housing 50 with the gas chamber 58 a through passage or opening 86 is provided in the cap 54 and preferably in the center of the top of the cap 54.

In use, the net difference of the force produced by the spring 78 and the gas in the gas chamber 58 acting on the diaphragm 56 is opposed by the fuel in the fuel chamber 60 acting on the diaphragm 56 and when the valve 64 is open, the forces on the valve 64 are transmitted to the diaphragm 56 through the actuator pin 66. The opposing forces acting on the valve 64 are the force produced by the bias of the spring 70 plus the force produced by the difference between the pressure of the fuel in the fuel chamber 60 and the fuel supplied by the pump through the inlet 62 acting on the effective areas of the opposed faces of the first valve 64. Because normal engine operation usually produces dynamic and varying conditions, not steady state static conditions, the first valve 64 usually rapidly opens and closes or hunts to maintain a substantially constant differential pressure across the fuel injectors by varying the absolute pressure of the fuel supplied by the regulator to the fuel rail.

Under certain conditions, such as engine deceleration or hot soak, the first valve 64 closes and the fuel trapped in the rail may be heated sufficiently to expand its volume. The expanding fuel deflects the diaphragm 56 upwardly and the spring 70 adjacent the first valve 64 biases the first valve 64 to a closed position onto the valve seat 68. The deflection of the diaphragm 56 both accumulates the expanded fuel and also decreases the extent to which the pressure in the fuel chamber 60 increases, and thus helps to prevent excessive pressure build-up. Such excessive pressure would cause the fuel in the rail to be forced through the injectors causing them to malfunction.

If, due to heating, the pressure of the expanded fuel becomes excessive, it will cause the first valve 64 to be forced open against the bias of the spring 70 to provide pressure relief by back bleeding fuel past the first valve 64 and through the inlet 62 to thereby limit the maximum pressure build-up of the expanded fuel trapped in the rail and fuel chamber 60. Once the pressure of the trapped fuel and the rail and chamber 60 returns to the maximum value, the first valve 64 again closes.

During use, when the fuel pressure regulator 12 and the fuel within the regulator become heated, the temperature within the gas chamber 58 can increase to a point where the force of the spring 78 which biases the diaphragm 56 decreases. This permits the diaphragm 56 to deflect more easily and thus further increase the volume of the liquid fuel chamber 60. This also lowers the pressure at which fuel is delivered to the fuel injectors and thereby adversely affects the performance of the engine.

In accordance with this invention, to compensate for the decreased spring force due to increasing temperature and to prevent liquid flow through the opening 86 in the cap 54, a second valve 14 is provided in the chamber 58. The second valve 14 permits gaseous flow from the exterior of the housing 50 into the gas chamber 58 when the pressure within the gas chamber 58 is sufficiently lower then the gaseous pressure exterior of the housing 50. The second valve 14 also prevents gaseous flow from within the chamber 58 to the exterior of the housing 50 and thus, when the gas chamber 58 becomes heated and the pressure within the gas chamber 58 increases above the pressure exterior of the housing 50, the valve closes and there is no gaseous flow through the valve 14. This increased pressure within the gas chamber 58 acts on the diaphragm 56 and compensates for the decrease in the force of spring 78 acting on the diaphragm 56 and thereby maintains a sufficiently high pressure of the fuel delivered to the fuel injectors.

Figure 3:
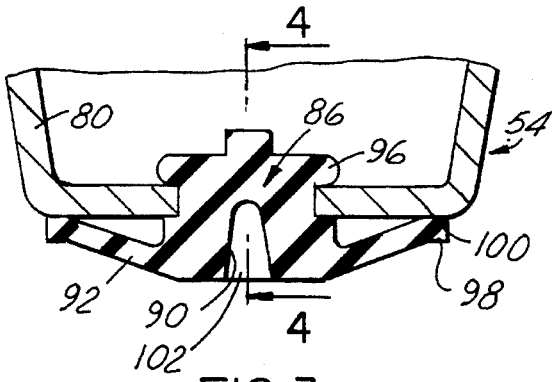
FIG. 3 is an enlarged fragmentary sectional view of the encircled portion 3 in FIG. 2.
Figure 4:
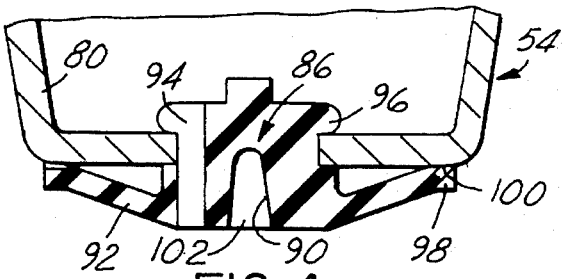
FIG. 4 is an enlarged fragmentary sectional view illustrating a through passage communicating the valve head with the exterior of the regulator.

A preferred construction of the valve 14 is shown in FIGS. 2–4. Preferably, the valve 14 has a generally annular stem 90 and a generally annular, dome-shaped head 92. The stem 90 is preferably inserted into the opening 86 of the cap 54 and, to allow gaseous flow from the exterior of the housing 50 through the opening 86, the stem 90 has a recess 94 therein providing a passage communicating the exterior of the housing 50 with the gas chamber 58 when the valve 14 is open. Also preferably, to retain the second valve 14 adjacent the opening 86, the stem 90 has a generally annular flange 96 slightly larger than the opening 86 and constructed to overlie the opening when the stem is received therein.

Preferably the head 92 of the valve 14 is generally dome-shaped and extends generally radially from the stem 90, contacting the housing 50 about its periphery to close the valve and prevent the opening 86 from communicating with chamber 58. Preferably, to open the valve 14 and permit gaseous flow through the valve 14 and into the gas chamber 58, at least the head 92 of the valve 14 is formed of a somewhat resilient material permitting at least a portion of the head 92 to be displaced from the housing 50 when the pressure within the gas chamber 58 is sufficiently lower than the pressure of gases immediately exterior of the gas chamber 58. Also preferably, to provide a substantially continuous contact surface for providing a seal between the second valve 14 and the cap 54, the head 92 has an annular rim 98 with a substantially flat face 100 constructed to contact the cap 54. To enable the perimeter of the head 92 to be more easily displaced from the cap 54 and thereby open the valve 14, the valve 14 is preferably formed with a depression or cavity 102 extending into and coaxial with the stem 90.

As shown in FIGS. 2, 3 and 4 the head 92 of the valve 14 is generally convex relative to the interior of the gas chamber 58. When the pressure exterior of the cap 54 is less than the pressure inside the gas chamber 58, the pressure inside the gas chamber 58 will tend to compress the head 92 of the valve 14 and thereby improve the seal between the valve 14 and the cap 54 and prevent gaseous flow through the valve 14 to the exterior of the housing 50. Similarly, if the diaphragm 56 were to rupture, liquid fuel would fill the gas chamber 58 and tend to compress the head 92 of the second valve 14 into the cap 54 thereby improving the seal between the valve 14 and the cap 54 and preventing liquid fuel from escaping through the recess 94 and opening 86 to the exterior of the housing 50.

Figure 5:
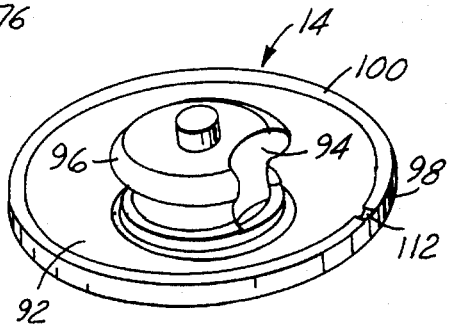
FIG. 5 is a perspective view of a valve of this invention.
Figure 6:
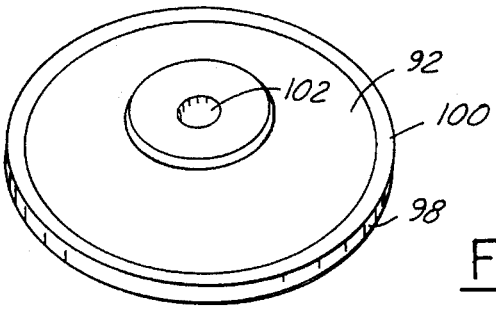
FIG. 6 is an end view of the valve.

In a modified from 14' of the second valve 14, as shown in FIG. 5, to communicate the exterior of the housing 50 with the gas chamber 58 and thereby maintain the gas chamber 58 at substantially the same pressure as the exterior of the housing 50, a notch 112 is provided in the rim 98 of the head 92 of the second valve 14'. Thus, in this form 14', gaseous flow can also occur from the gas chamber 58 through the notch 112, through the recess 94 of the stem 90, and to the exterior of the housing 50. However, in the event of a diaphragm 56 rupture, when liquid fuel under pressure fills the gas chamber 58 the second valve 14' will be compressed into the cap 54 sufficiently to close the notch 112 and thereby prevent the escape of liquid fuel through the opening 86.

Figure 7:
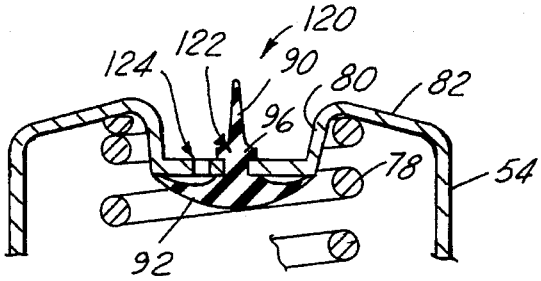
FIG. 7 is a sectional view of an alternate embodiment of the valve.
Figure 8:
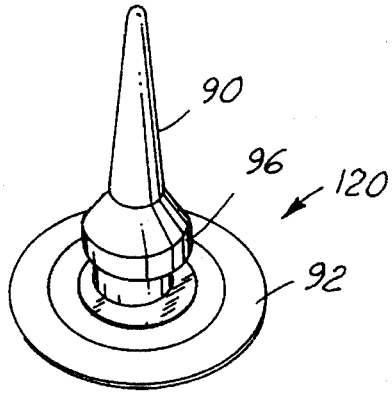
FIG. 8 is a perspective view of the alternate embodiment of the valve of FIG. 7.

In a second embodiment 120, as shown in FIGS. 7 and 8, a pair of openings 122 and 124 are provided in the cap 54. One of the openings 122 mounts the second valve 14" and the other opening 124 provides a through passage to communicate the exterior of the housing 50 with the gas chamber 58 when the second valve 14" is open. Preferably, in this embodiment 120 the stem 90 of the second valve 14" does not have a recess and thus, gaseous flow occurs only through the other opening 124. Also preferably, to facilitate mounting the valve 14" the stem 90 is elongate and extends through the opening 86.

The construction and function of the second valve 14" is substantially the same as that of the preferred embodiment 14 and hence, will not be repeated. Further, as in the second form 14' of the valve 14, a notch 112 can be provided in the head 92 of the second valve 14" of the second embodiment 120 to provide an air-bleed passage. Again, the function of the second valve 14" with the air-bleed passage is the same as described above and will not be repeated for this embodiment.

In use, the second valve 14 of this invention prevents liquid flow through the gas chamber 58 to the exterior of the regulator housing 50. Additionally, in the embodiments without the air-bleed passage in the head 92 of the second valve 14, the second valve 14 can maintain superatmospheric pressure in the gas chamber 58 to act on the diaphragm 56 and compensate for the decrease in spring force caused by an increase in temperature in the gas chamber 58.

What is claimed is:

1. A fuel pressure regulator for a no-return fuel delivery system for an internal combustion engine with an air intake manifold and at least one fuel injector comprising:

a housing;

a flexible diaphragm defining in cooperation with the housing, first and second chambers and having generally opposed faces with one face communicating with only the first chamber and the other face communicating with only the second chamber;

an inlet in the first chamber for supplying fuel to the first chamber;

a first valve associated with the inlet and movable to open and closed positions to control the flow of fuel through the inlet;

an outlet in the first chamber for continuously communicating the first chamber with at least one fuel injector to supply fuel thereto;

at least one opening communicating the interior of the second chamber with the exterior of the housing; and a second valve associated with said at least one opening to prevent any liquid in the second chamber from passing through the opening to the exterior of the housing.

2. The fuel pressure regulator of claim 1 also comprising a spring yieldably biasing the diaphragm in a direction tending to decrease the volume of the first chamber and the second valve closes the opening to prevent air in the second chamber from passing through the opening to the exterior of the housing to provide a superatmospheric pressure within the second chamber when the air in the second chamber becomes heated, and said superatmospheric pressure of the air in the second chamber acts on the diaphragm.

3. The pressure regulator of claim 2 wherein the second valve opens when the pressure within the second chamber is lower than the pressure of gases immediately exterior of the second chamber to permit gaseous flow into the second chamber.

4. The pressure regulator of claim 2 wherein the second valve has a stem mounted in the opening and having at least a portion slightly larger in size than the opening to provide an interference fit to retain the second valve adjacent the opening, and a generally dome-shaped head extending generally radially from the stem, contacting the housing about its periphery, and formed of a somewhat resilient material permitting at least a portion of the head to be displaced from the housing when the pressure within the second chamber is sufficiently lower than the pressure of gases immediately exterior of the second chamber to open the second valve and permit gaseous flow through the second valve and into the second chamber.

5. The pressure regulator of claim 1 wherein the second valve has a notch formed therein adjacent the housing providing an air-bleed passage that communicates the second chamber with the exterior of the housing to permit gaseous flow from the second chamber to the exterior of the housing to maintain the pressure within the second chamber substantially equal to the pressure of gases immediately exterior of the second chamber.

6. The pressure regulator of claim 5 wherein the second valve has a stem mounted in the opening and having at least a portion slightly larger in size than the opening to provide an interference fit to retain the second valve adjacent the opening, and a generally dome-shaped head extending generally radially from the stem, contacting the housing about its periphery, and formed of a somewhat resilient material permitting at least a portion of the head to be displaced from the housing when the pressure within the second chamber is sufficiently lower than the pressure of gases immediately exterior of the second chamber to open the second valve and permit gaseous flow through the second valve and into the second chamber.

7. The pressure regulator of claim 1 which comprises a pair of openings and one of said openings provides a through passage communicating the second chamber with the exterior of the housing and the other of said openings mounts the second valve adjacent the openings to prevent fluid flow from the second chamber to the exterior of the housing.

8. The pressure regulator of claim 1 wherein said at least one opening comprises a single opening which communicates the second chamber with the exterior of the housing and mounts the second valve which prevents fluid flow from the second chamber to the exterior of the housing.

9. The pressure regulator of claim 8 wherein the second valve has a recess formed therein communicating the exterior of the housing with the second chamber when the second valve is open.

10. The pressure regulator of claim 4 wherein the head has an annular rim with a generally flat face providing a substantially continuous contact surface for providing a seal between the second valve and the housing.

11. The pressure regulator of claim 10 wherein a notch is formed in the rim providing an air-bleed passage to permit air within the second chamber to pass through the second valve.

12. The pressure regulator of claim 4 wherein the stem has an annular flange larger in diameter than the opening that is constructed to overlie the opening when the second valve is mounted therein to retain the second valve adjacent the opening.

13. The pressure regulator of claim 6 wherein the head has an annular rim with a generally flat face providing a substantially continuous contact surface for providing a seal between the second valve and the housing.

14. The pressure regulator of claim 6 wherein the stem has an annular flange larger in diameter than the opening and that is constructed to overlie the opening when the second valve is mounted therein to retain the second valve adjacent the opening.

* * * * *